US005522011A

United States Patent [19]

Epstein et al.

[11] Patent Number: 5,522,011

[45] Date of Patent: May 28, 1996

[54] SPEECH CODING APPARATUS AND METHOD USING CLASSIFICATION RULES

[75] Inventors: Mark E. Epstein, Katonah; Ponani S. Gopalakrishnan, Yorktown Heights; David Nahamoo; Michael A. Picheny, both of White Plains; Jan Sedivy, Hartsdale, all of N.Y.

[73] Assignee: International Business Machines Corporation, Armonk, N.Y.

[21] Appl. No.: 127,392

[22] Filed: Sep. 27, 1993

[51] Int. Cl.[6] ..... G10L 5/06

[52] U.S. Cl. ..... 395/2.31

[58] Field of Search ..... 395/2.54, 2.31; 381/36

[56] References Cited

U.S. PATENT DOCUMENTS

| | | | |
|---|---|---|---|
| 4,715,004 | 12/1987 | Kabasawa et al. | 364/513.5 |
| 4,907,276 | 3/1990 | Aldersberg | 381/36 |
| 4,958,375 | 9/1990 | Reilly et al. | 382/14 |
| 4,980,918 | 12/1990 | Bahl et al. | 381/43 |
| 5,067,152 | 11/1991 | Kisor et al. | 380/10 |
| 5,144,671 | 9/1992 | Mazor et al. | 381/36 |
| 5,182,773 | 1/1993 | Bahl et al. | 381/41 |
| 5,327,520 | 7/1994 | Chen | 395/2.28 |
| 5,345,536 | 9/1994 | Hoshimi et al. | 395/2.52 |

FOREIGN PATENT DOCUMENTS

| | | | |
|---|---|---|---|
| 0535380A2 | 8/1992 | European Pat. Off. | G10L 5/00 |
| 0538626A2 | 9/1992 | European Pat. Off. | G10L 3/00 |
| 0545083A2 | 11/1992 | European Pat. Off. | G10L 5/06 |

OTHER PUBLICATIONS

Bahl, L. R., et al. "Vector Quantization Procedure For Speech Recognition Systems Using Discrete Parameter Phoneme–Based Markov Word Models." *IBM Technical Disclosure Bulletin,* vol. 32, No. 7, Dec. 1989, pp. 320–321.

Jelinek, F. "Continuous Speech Recognition by Statistical Methods." *Proceedings of the IEEE,* vol. 64, No. 4, Apr. 1976, pp. 532–556.

Nadas, A., et al. "An Iterative Flip–Flop Approximation of the Most Informative Split in the Construction of Decision Trees." *1991 International Conference on Acoustics, Speech and Signal Processing,* pp. 565–568.

*Primary Examiner*—Allen R. MacDonald
*Assistant Examiner*—Thomas J. Onka
*Attorney, Agent, or Firm*—Whitham, Curtis, Whitham & McGinn; Robert P. Tassinari

[57] ABSTRACT

A speech coding apparatus and method uses classification rules to code an utterance while consuming fewer computing resources. The value of at least one feature of an utterance is measured during each of a series of successive time intervals to produce a series of feature vector signals representing the feature values. The classification rules comprise at least first and second sets of classification rules. The first set of classification rules map each feature vector signal from a set of all possible feature vector signals to exactly one of at least two disjoint subsets of feature vector signals. The second set of classification rules map each feature vector signal in a subset of feature vector signals to exactly one of at least two different classes of prototype vector signals. Each class contains a plurality of prototype vector signals. According to the classification rules, a first feature vector signal is mapped to a first class of prototype vector signals. The closeness of the feature value of the first feature vector signal is compared to the parameter values of only the prototype vector signals in the first class of prototype vector signals to obtain prototype match scores for the first feature vector signal and each prototype vector signal in the first class. At least the identification value of at least the prototype vector signal having the best prototype match score is output as a coded utterance representation signal of the first feature vector signal.

25 Claims, 6 Drawing Sheets

SPEECH CODING APPARATUS AND METHOD USING CLASSIFICATION RULES

BACKGROUND OF THE INVENTION

The invention relates to speech coding, such as for computerized speech recognition systems.

In computerized speech recognition systems, an acoustic processor measures the value of at least one feature of an utterance during each of a series of successive time intervals to produce a series of feature vector signals representing the feature values. For example, each feature may be the amplitude of the utterance in each of twenty different frequency bands during each of series of 10-millisecond time intervals. A twenty-dimension acoustic feature vector represents the feature values of the utterance for each time interval.

In discrete parameter speech recognition systems, a vector quantizer replaces each continuous parameter feature vector with a discrete label from a finite set of labels. Each label identifies one or more prototype vectors having one or more parameter values. The vector quantizer compares the feature values of each feature vector to the parameter values of each prototype vector to determine the best matched prototype vector for each feature vector. The feature vector is then replaced with the label identifying the best-matched prototype vector.

For example, for prototype vectors representing points in an acoustic space, each feature vector may be labeled with the identity of the prototype vector having the smallest Euclidean distance to the feature vector. For prototype vectors representing Gaussian distributions in an acoustic space, each feature vector may be labeled with the identity of the prototype vector having the highest likelihood of yielding the feature vector.

For large numbers of prototype vectors (for example, a few thousand), comparing each feature vector to each prototype vector consumes significant processing resources by requiring many time-consuming computations.

SUMMARY OF THE INVENTION

It is an object of the invention to provide a speech coding apparatus and method for labeling an acoustic feature vector with the identification of the best-matched prototype vector while consuming fewer processing resources.

It is another object of the invention to provide a speech coding apparatus and method for labeling an acoustic feature vector with the identification of the best-matched prototype vector without comparing each feature vector to all prototype vectors.

According to the invention, a speech coding apparatus and method measure the value of at least one feature of an utterance during each of a series of successive time intervals to produce a series of feature vector signals representing the feature values. A plurality of prototype vector signals are stored. Each prototype vector signal has at least one parameter value and has an identification value. At least two prototype vector signals have different identification values.

Classification rules are provided for mapping each feature vector signal from a set of all possible feature vector signals to exactly one of at least two different classes of prototype vector signals. Each class contains a plurality of prototype vector signals.

Using the classification rules, a first feature vector signal is mapped to a first class of prototype vector signals. The closeness of the feature value of the first feature vector signal is compared to the parameter values of only the prototype vector signals in the first class of prototype vector signals to obtain prototype match scores for the first feature vector signal and each prototype vector signal in the first class. At least the identification value of at least the prototype vector signal having the best prototype match score is output as a coded utterance representation signal of the first feature vector signal.

Each class of prototype vector signals is at least partially different from other classes of prototype vector signals.

Each class i of prototype vector signals may, for example, contain less than $1/N_1$ times the total number of prototype vector signals in all classes, where $5 \leqq N_i \leqq 150$. The average number of prototype vector signals in a class of prototype vector signals may be, for example, approximately equal to 1/10 times the total number of prototype vector signals in all classes.

In one aspect of the invention, the classification rules may comprise, for example, at least first and second sets of classification rules. The first set of classification rules map each feature vector signal from a set of all possible feature vector signals (for example, obtained from a set of training data used to design different parts of the system) to exactly one of at least two disjoint subsets of feature vector signals. The second set of classification rules map each feature vector signal in a subset of feature vector signals to exactly one of at least two different classes of prototype vector signals.

In this aspect of the invention, the first feature vector signal is mapped, by the first set of classification rules, to a first subset of feature vector signals. The first feature vector signal is then further mapped, by the second set of classification rules, from the first subset of feature vector signals to the first class of prototype vector signals.

In another variation of the invention, the second set of classification rules may comprise, for example, at least third and fourth sets of classification rules. The third set of classification rules map each feature vector signal from a subset of feature vector signals to exactly one of at least two disjoint sub-subsets of feature vector signals. The fourth set of classification rules map each feature vector signal in a sub-subset of feature vector signals to exactly one of at least two different classes of prototype vector signals.

In this aspect of the invention, the first feature vector signal is mapped, by the third set of classification rules, from the first subset of feature vector signals to a first sub-subset of feature vector signals. The first feature vector signal is then further mapped, by the fourth set of classification rules, from the first sub-subset of feature vector signals to the first class of prototype vector signals.

In a preferred embodiment of the invention, the classification rules comprise at least one scalar function mapping the feature values of a feature vector signal to a scalar value. At least one rule maps feature vector signal whose scalar function is less than a threshold to the first subset of feature vector signals. Feature vector signals whose scalar function is greater than the threshold are mapped to a second subset of feature vector signals different from the first subset.

Preferably, the speech coding apparatus and method measure the values of at least two features of an utterance during each of a series of successive time intervals to produce a series of feature vector signals representing the feature values. The scalar function of a feature vector signal comprises the value of only a single feature of the feature vector signal.

The measured features may be, for example, the amplitudes of the utterance in two or more frequency bands during each of a series of successive time intervals.

By mapping each feature vector signal to an associated class of prototype vectors, and by comparing the closeness of the feature value of a feature vector signal to the parameter values of only the prototype vector signals in the associated class of prototype vector signals, the speech coding apparatus and method according to the present invention can label each feature vector with the identification of the best-matched prototype vector without comparing the feature vector to all prototype vectors, thereby consuming significantly fewer processing resources.

DESCRIPTION OF THE PREFERRED EMBODIMENTS

Figure 1:
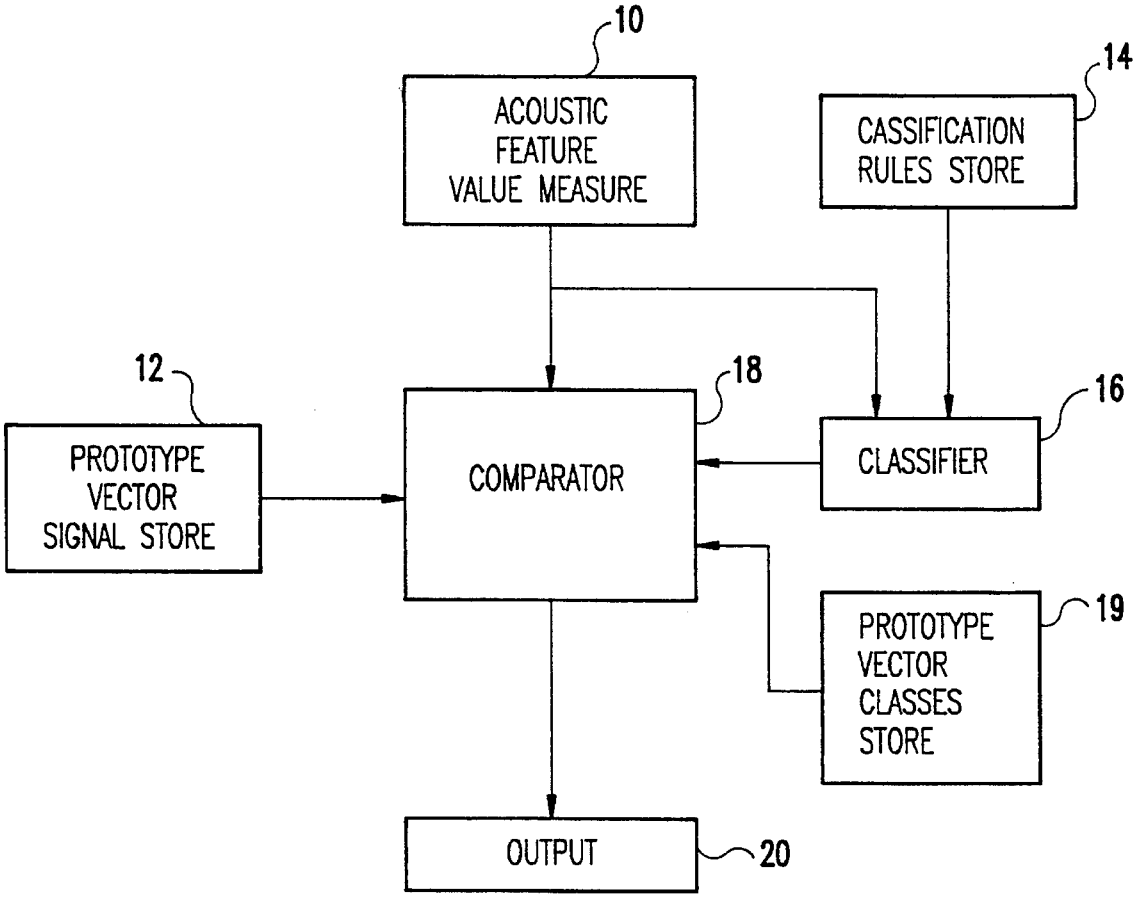
FIG. 1 is a block diagram of an example of a speech coding apparatus according to the invention.

FIG. 1 is a block diagram of an example of a speech coding apparatus according to the invention. The speech coding apparatus comprises an acoustic feature value measure 10 for measuring the value of at least one feature of an utterance during each of a series of successive time intervals to produce a series of feature vector signals representing the feature values. As described in more detail below, the acoustic feature value measure 10 may, for example, measure the amplitude of an utterance in each of twenty frequency bands during each of a series of ten-millisecond time intervals to produce a series of twenty-dimension feature vector signals representing the amplitude values.

Table 1 shows a hypothetical example of the values $X_A$, $X_B$, and $X_C$, of features A, B, and C respectively, of an utterance during each of a series of successive time intervals t from t=0 to t=6.

TABLE 1

| | MEASURED FEATURE VALUES | | | | | | | |
|---|---|---|---|---|---|---|---|---|
| Time (t) | 0 | 1 | 2 | 3 | 4 | 5 | 6 | . . . |
| Feature A ($X_A$) | 0.159 | 0.125 | 0.053 | 0.437 | 0.76 | 0.978 | 0.413 | . . . |
| Feature B ($X_B$) | 0.476 | 0.573 | 0.63 | 0.398 | 0.828 | 0.054 | 0.652 | . . . |
| Feature C ($X_C$) | 0.084 | 0.792 | 0.434 | 0.564 | 0.737 | 0.137 | 0.856 | . . . |

The speech coding apparatus further comprises a prototype vector signal store 12 storing a plurality of prototype vector signals. Each prototype vector signal has at least one parameter value and has an identification value. At least two prototype vector signals have different identification values. As described in more detail below, the prototype vector signals in prototype vector signals store 12 may be obtained, for example, by clustering feature vector signals from a training set into a plurality of clusters. The mean (and optionally the variance) for each cluster forms the parameter value of the prototype vector.

Table 2 shows a hypothetical example of the values $Y_A$, $Y_B$, and $Y_C$, of parameters A, B, C, respectively, of a set of prototype vector signals. Each prototype vector signal has an identification value in the range from L1 through L20. At least two prototype vector signals have different identification values. However, two or more prototype vector signals may also have the same identification values.

TABLE 2

| PROTOTYPE VECTOR PARAMETER VALUES | | | | | | | | |
|---|---|---|---|---|---|---|---|---|
| Prototype Feature B Identification | L1 | L2 | L3 | L1 | L4 | L5 | L6 | L7 |
| Prototype Vector Class(es) | C2, C7 | C5 | C3 | C4 | C1 | C2 | C1, C3 | C7 |
| Parameter A ($Y_A$) | 0.486 | 0.899 | 0.437 | 0.901 | 0.260 | 0.478 | 0.223 | 0.670 |
| Parameter B ($Y_B$) | 0.894 | 0.501 | 0.633 | 0.189 | 0.172 | 0.786 | 0.725 | 0.652 |
| Parameter C ($Y_C$) | 0.489 | 0.911 | 0.794 | 0.298 | 0.95 | 0.194 | 0.978 | 0.808 |
| Index | P1 | P2 | P3 | P4 | P5 | P6 | P7 | P8 |
| Prototype Identification | L8 | L9 | L1 | L10 | L11 | L9 | L12 | L13 |
| Prototype Vector Class(es) | C0 | C3, C6 | C2 | C7 | C0, C3 C4 | C3 | C6 | C3 |
| Parameter A ($Y_A$) | 0.416 | 0.570 | 0.166 | 0.551 | 0.317 | 0.428 | 0.723 | 0.218 |
| Parameter B ($Y_B$) | 0.042 | 0.889 | 0.693 | 0.623 | 0.935 | 0.720 | 0.763 | 0.557 |

TABLE 2-continued

| PROTOTYPE VECTOR PARAMETER VALUES | | | | | | | | |
|---|---|---|---|---|---|---|---|---|
| Parameter C ($Y_C$) | 0.192 | 0.590 | 0.492 | 0.901 | 0.645 | 0.950 | 0.006 | 0.996 |
| Index | P9 | P10 | P11 | P12 | P13 | P14 | P15 | P16 |
| Prototype Identification | L14 | L15 | L6 | L16 | L17 | L18 | L7 | L10 |
| Prototype Vector Class(es) | C4 | C1 | C0, C6 | C4 | C6 | C1 | C5, C7 | C0 |
| Parameter A ($Y_A$) | 0.809 | 0.298 | 0.322 | 0.869 | 0.622 | 0.424 | 0.522 | 0.481 |
| Parameter B ($Y_B$) | 0.193 | 0.395 | 0.335 | 0.069 | 0.645 | 0.112 | 0.800 | 0.358 |
| Parameter C ($Y_C$) | 0.687 | 0.467 | 0.143 | 0.668 | 0.121 | 0.429 | 0.936 | 0.180 |
| Index | P17 | P18 | P19 | P20 | P21 | P22 | P23 | P24 |
| Prototype Identification | L19 | L17 | L2 | L20 | L8 | L14 | ... | |
| Prototype Vector Class(es) | C0 | C5 | C2, C4 | C5 | C4 | C2 | ... | |
| Parameter A ($Y_A$) | 0.410 | 0.933 | 0.693 | 0.838 | 0.847 | 0.109 | ... | |
| Parameter B ($Y_B$) | 0.320 | 0.373 | 0.165 | 0.281 | 0.335 | 0.476 | ... | |
| Parameter C ($Y_C$) | 0.191 | 0.911 | 0.387 | 0.989 | 0.632 | 0.288 | ... | |
| Index | P25 | P26 | P27 | P28 | P29 | P30 | ... | |

In order to distinguish between different prototype vector signals having the same identification value, each prototype vector signal in Table 2 is assigned a unique index P1 to P30. In the example of Table 2, prototype vector signals indexed as P1, P4, and P11 all have the same identification value L1. Prototype vector signals indexed as P1 and P2 have different identification values L1 and L2, respectively.

Returning to FIG. 1, the speech coding apparatus comprises a classification rules store 14. The classification rules store 14 stores classification rules mapping each feature vector signal from a set of all possible feature vector signals to exactly one of at least two different classes of prototype vector signals. Each class of prototype vector signals contains a plurality of prototype vector signals.

As shown in Table 2 above, each prototype vector signal P1 through P30 is assigned to a hypothetical prototype vector class C0 through C7. In this hypothetical example, some prototype vector signals are contained in only one prototype vector signal class, while other prototype vector signals are contained in two or more classes. In general, a given prototype vector may be contained in more than one class, provided that each class of prototype vector signals is at least partially different from other classes of prototype vector signals.

Table 3 shows a hypothetical example of classification rules stored in the classification rules store 14.

TABLE 3

| | CLASSIFICATION RULES | | | | | | | |
|---|---|---|---|---|---|---|---|---|
| Prototype Vector Class | C0 | C1 | C2 | C3 | C4 | C5 | C6 | C7 |
| Feature A ($X_A$) Range | <.5 | <.5 | <.5 | <.5 | ≧.5 | ≧.5 | ≧.5 | ≧.5 |
| Feature B ($X_B$) Range | <.4 | <.4 | ≧.4 | ≧.4 | <.6 | <.6 | ≧.6 | ≧.6 |
| Feature C ($X_C$) Range | <.2 | ≧.2 | <.6 | ≧.6 | <.7 | ≧.7 | <.8 | ≧.8 |

In this example, the classification rules map each feature vector signal from a set of all possible feature vector signals to exactly one of eight different classes of prototype vector signals. For example, the classification rules map feature vector signals having a Feature A value $X_a<0.5$, having a Feature B value $X_B<0.4$, and having a Feature C value $X_C<0.2$ to prototype vector class C0.

Figure 2:
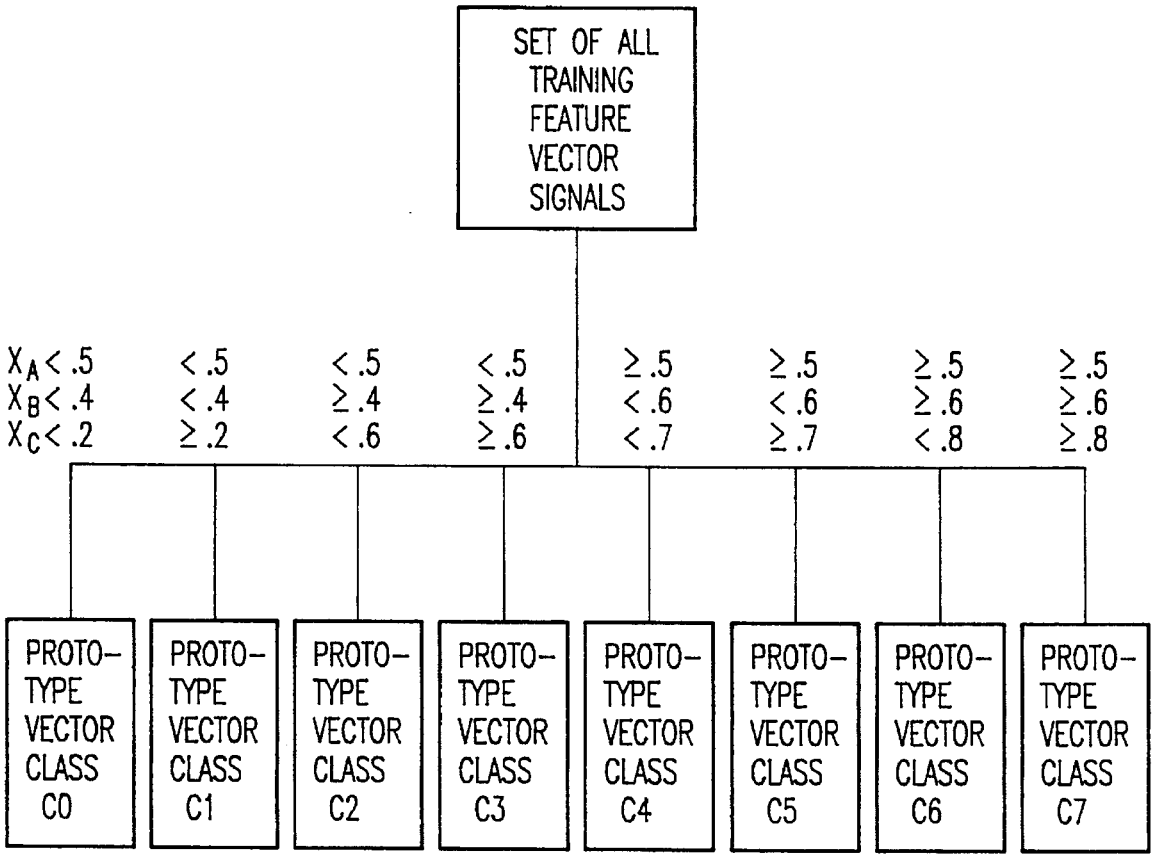
FIG. 2 schematically shows an example of classification rules for mapping each feature vector signal to exactly one of at least two different classes of prototype vector signals.

FIG. 2 schematically shows an example of how the hypothetical classification rules of Table 3 map each feature vector signal to exactly one class of prototype vector signals. While it is possible that the prototype vector signals in a class of prototype vector signals may satisfy the classification rules of Table 3, in general they need not. When a prototype vector signal is contained in more than one class, the prototype vector signal will not satisfy the classification rules for at least one class of prototype vector signals.

In the example, each class of prototype vector signals contains from 1/5 to 1/15 times the total number of prototype vector signals in all classes. In general, the speech coding apparatus according to the present invention can obtain a significant reduction in computation time while maintaining acceptable labeling accuracy if each class i of prototype vector signals contains less than $1/N_i$ times the total number of prototype vector signals in all classes, where $5 \leqq N_i \leqq 150$. Good results can be obtained, for example, when the average number of prototype vector signals in a class of prototype vector signals is approximately equal to 1/10 times the total number of prototype vector signals in all classes.

The speech coding apparatus further comprises a classifier 16 for mapping, by the classification rules in classification rules store 14, a first feature vector signal to a first class of prototype vector signals.

Figure 3:
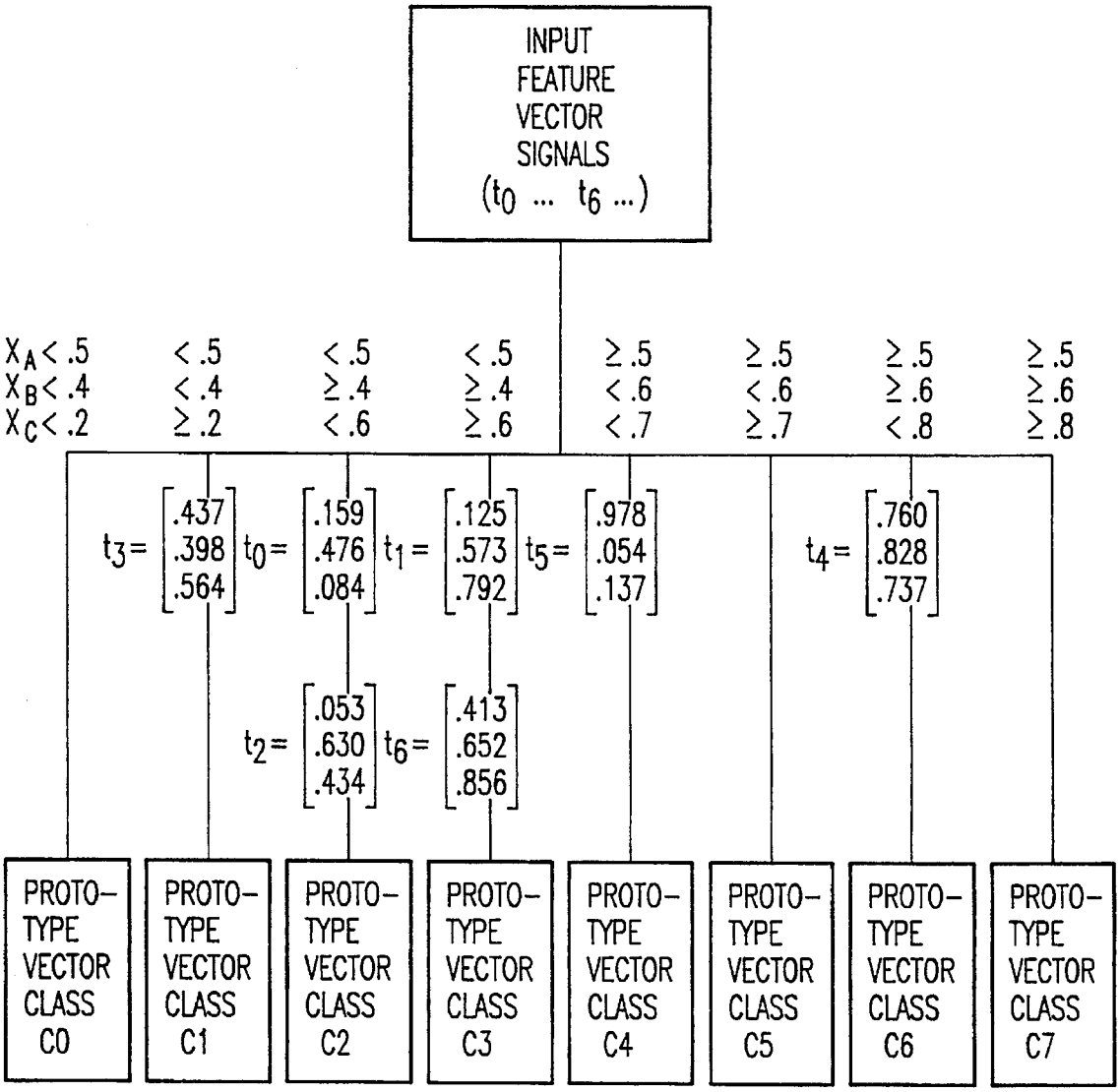
FIG. 3 schematically shows an example of a classifier for mapping an input feature vector signal to a class of prototype vector signals.

Table 4 and FIG. 3 show how the hypothetical measured feature values of the input feature vector signals of Table 1 are mapped to prototype vector classes CO through C7 using the hypothetical classification rules of Table 3 and FIG. 2.

TABLE 4

| | MEASURED FEATURE VALUES | | | | | | | |
|---|---|---|---|---|---|---|---|---|
| Time | 0 | 1 | 2 | 3 | 4 | 5 | 6 | ... |
| Feature A ($X_A$) | 0.159 | 0.125 | 0.053 | 0.437 | 0.76 | 0.978 | 0.413 | ... |
| Feature B ($X_B$) | 0.476 | 0.573 | 0.63 | 0.398 | 0.828 | 0.054 | 0.652 | ... |
| Feature C ($X_C$) | 0.084 | 0.792 | 0.434 | 0.564 | 0.737 | 0.137 | 0.856 | ... |
| Prototype Vector Class | C2 | C3 | C2 | C1 | C6 | C4 | C3 | |

Returning to FIG. 1, the speech coding apparatus comprises a comparator 18. Comparator 18 compares the closeness of the feature value of the first feature vector signal to the parameter values of only the prototype vector signals in the first class of prototype vector signals (to which the first feature vector signal mapped by classifier 16 according to the classification rules) to obtain prototype match scores for the first feature vector signal and each prototype vector signal in the first class. An output unit 20 of FIG. 1 outputs at least the identification value of at least the prototype vector signal having the best prototype match score as a coded utterance representation signal of the first feature vector signal.

Table 5 is a summary of the identities of the prototype vectors contained in each of the prototype vector classes C0 through C7 from Table 2.

TABLE 5

CLASSES OF PROTOTYPE VECTORS

| PROTOTYPE VECTOR CLASS | PROTOTYPE VECTORS | | | | | |
|---|---|---|---|---|---|---|
| C0 | P9, | P13, | P19, | P24, | P25 | |
| C1 | P5, | P7, | P18, | P22 | | |
| C2 | P1, | P6, | P11, | P27, | P30 | |
| C3 | P3, | P7, | P10, | P13, | P14, | P16 |
| C4 | P4, | P13, | P17, | P20, | P27, | P29 |
| C5 | P2, | P23, | P26, | P28 | | |
| C6 | P10, | P15, | P19, | P21 | | |
| C7 | P1, | P8, | P12, | P23 | | |

The table of prototype vectors contained in each prototype vector class may be stored in the comparator 18, or in a prototype vector classes store 19.

Table 6 shows an example of the comparison of the closeness of the feature values of each feature vector in Table 4 to the parameter values of only the prototype vector signals in the corresponding class of prototype vector signals also shown in Table 4.

TABLE 6

$$\text{Distance} = \sqrt{(X_A - Y_A)^2 + (X_B - Y_B)^2 + (X_C - Y_C)^2}$$

| Feature Vector (time) | 0 | 1 | 2 | 3 | 4 | 5 | 6 |
|---|---|---|---|---|---|---|---|
| Prototype | | | | | | | |
| P1 | 0.668 | — | 0.510 | — | — | — | — |
| P2 | — | — | — | — | — | — | — |
| P3 | — | 0.318 | — | — | — | — | 0.069 |
| P4 | — | — | — | — | — | 0.224 | |
| P5 | — | — | — | 0.481 | — | — | — |
| P6 | 0.458 | — | 0.512 | — | — | — | — |
| P7 | — | 0.259 | — | 0.569 | — | — | 0.237 |
| P8 | — | — | — | — | — | — | — |
| P9 | — | — | — | — | — | — | — |
| P10 | — | 0.582 | — | — | 0.248 | — | 0.389 |
| P11 | 0.462 | — | 0.142 | — | — | — | — |
| P12 | — | — | — | — | — | — | — |
| P13 | — | 0.435 | — | — | — | 1.213 | 0.366 |
| P14 | — | 0.372 | — | — | — | — | 0.117 |
| P15 | | | | | 0.735 | — | — |
| P16 | — | 0.225 | — | — | — | — | 0.258 |
| P17 | — | — | — | — | — | 0.592 | — |
| P18 | — | — | — | 0.170 | — | — | — |
| P19 | — | — | — | — | 0.888 | — | — |
| P20 | — | — | — | — | — | 0.542 | — |
| P21 | — | — | — | — | 0.657 | — | — |
| P22 | — | — | — | 0.317 | — | — | — |
| P23 | — | — | — | — | — | — | — |
| P24 | — | — | — | — | — | — | — |
| P25 | — | — | — | — | — | — | — |
| P26 | — | — | — | — | — | — | — |

TABLE 6-continued $$\text{Distance} = \sqrt{(X_A - Y_A)^2 + (X_B - Y_B)^2 + (X_C - Y_C)^2}$$

| Feature Vector (time) | 0 | 1 | 2 | 3 | 4 | 5 | 6 |
|---|---|---|---|---|---|---|---|
| P27 | 0.688 | — | 0.792 | — | — | 0.395 | — |
| P28 | — | — | — | — | — | — | — |
| P29 | — | — | — | — | — | 0.584 | — |
| P30 | 0.210 | — | 0.219 | — | — | — | — |
| Identification of Closest Prototype in Class | L14 | L13 | L1 | L15 | L9 | L1 | L3 |

In this example, the closeness of a feature vector signal to a prototype vector signal is determined by the Euclidean distance between the feature vector signal and the prototype vector signal.

If each prototype vector signal contains a mean value, a variance value, and a prior probability value, the closeness of a feature vector signal to a prototype vector signal may be the Gaussian likelihood of the feature vector signal given the prototype vector signal, multiplied by the prior probability.

As shown in Table 6 above, the feature vector at time t=0 corresponds to prototype vector class C2. Therefore, the feature vector is compared only to prototype vectors P1, P6, P11, P27, and P30 in prototype vector class C2. Since the closest prototype vector in class C2 is P30, the feature vector at time t=0 is coded with the identifier L14 of prototype vector signal P30, as shown in Table 6.

By comparing the closeness of the feature value of a feature vector signal to the parameter values of only the prototype vector signals in the class of prototype vector signals to which the feature vector signal is mapped by the classification rules, a significant reduction in computation time is achieved.

Since, according to the present invention, each feature vector signal is compared only to prototype vector signals in the class of prototype vector signals to which the feature vector signal is mapped, it is possible that the best-matched prototype vector signal in the class will differ from the best-matched prototype vector signal in the entire set of prototype vector signals, thereby resulting in a coding error. It has been found, however, that a significant gain in coding speed can be achieved using the invention, with only a small loss in coding accuracy.

Figure 4:
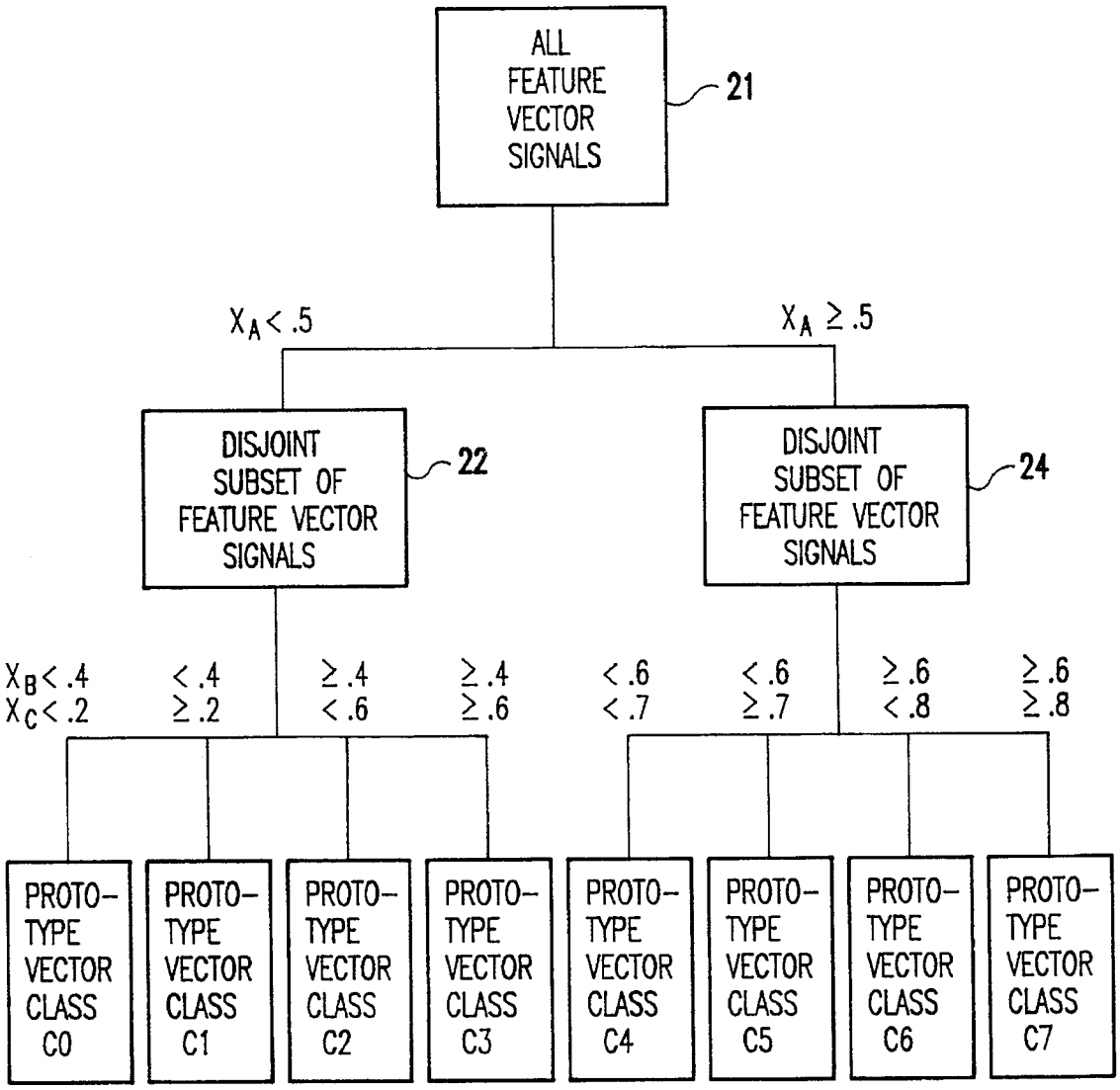
FIG. 4 schematically shows an example of classification rules for mapping each feature vector signal to exactly one of at least two disjoint subsets of feature vector signals, and for mapping each feature vector signal in a subset of feature vector signals to exactly one of at least two different classes of prototype vector signals.

The classification rules of Table 3 and FIG. 2 may comprise, for example, at least first and second sets of classification rules. As shown in FIG. 4, the first set of classification rules map each feature vector signal from a set 21 of all possible feature vector signals to exactly one of at least two disjoint subsets 22 or 24 of feature vector signals. The second set of classification rules map each feature vector signal in a subset of feature vector signals to exactly one of at least two different classes of prototype vector signals. In the example of FIG. 4, the first set of classification rules map each vector signal having a Feature A value $X_A$ less than 0.5 to disjoint subset 22 of feature vector signals. Each feature vector signal having Feature A value $X_A$ greater than or equal to 0.5 is mapped to disjoint subset 24 of feature vector signals.

The second set of classification rules in FIG. 4 map each feature vector signal from disjoint subset 22 of feature vector signals to one of prototype vector classes C0 through C3, and map feature vector signals from disjoint subset 24 to one of prototype vector classes C4 through C7. For example, feature vector signals from subset 22 having Feature B values $X_B$ less than 0.4 and having Feature C values $X_C$ greater than or equal to 0.2 are mapped to prototype vector class C1.

According to the present invention, the second set of classification rules may comprise, for example, at least third and fourth sets of classification rules. The third set of classification rules map each feature vector signal from a subset of feature vector signals to exactly one of at least two disjoint sub-subsets of feature vector signals. The fourth set of classification rules map each feature vector signal in a sub-subset of feature vector signals to exactly one of at least two different classes of prototype vector signals.

Figure 5:
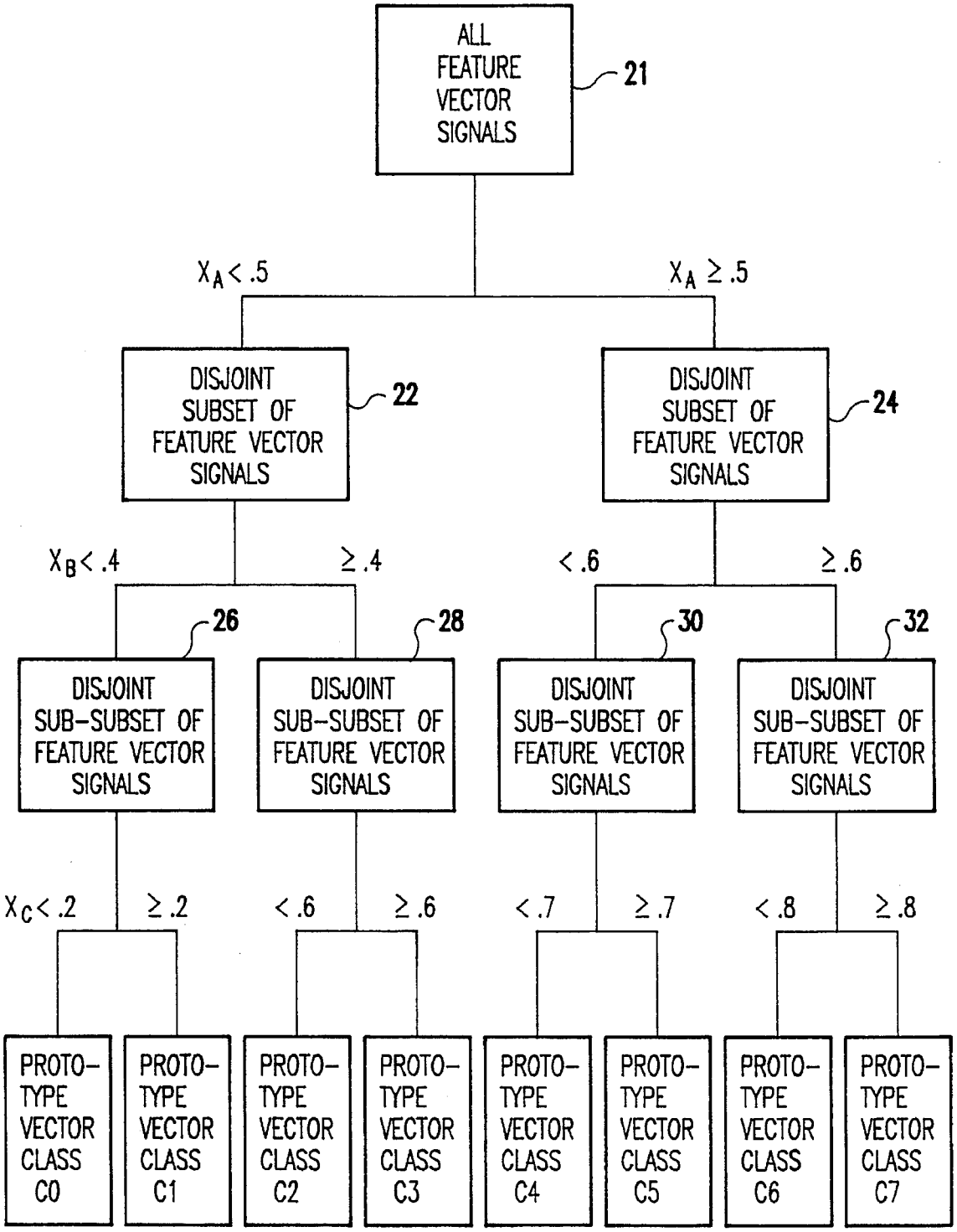
FIG. 5 schematically shows an example of classification rules for mapping each feature vector signal from a subset of feature vector signals to exactly one of at least two disjoint sub-subsets of feature vector signals, and for mapping each feature vector signal in a sub-subset of feature vector signals to exactly one of at least two different classes of prototype vector signals.

FIG. 5 schematically shows another implementation of the classification rules of Table 3. In this example, the third set of classification rules map each feature vector signal from disjoint subset 22 and having a Feature B value $X_B$ less than 0.4 to disjoint sub-subset 26. The feature vector signals from disjoint subset 22 and which have a Feature B value $X_B$ greater than or equal to 0.4 are mapped to disjoint sub-subset 28.

Feature vector signals from disjoint subset 24 which have a Feature B value $X_B$ less than 0.6 are mapped to disjoint sub-subset 30. Feature vector signals from disjoint subset 24 which have a Feature B value $X_B$ greater than or equal to 0.6 are mapped to disjoint sub-subset 32.

Still referring to FIG. 5, the fourth set of classification rules map each feature vector signal in a disjoint sub-subset 26, 28, 30 or 32 to exactly one of prototype vector classes C0 through C7. For example, feature vector signals from disjoint sub-subset 30 and which have a Feature C value $X_C$ less than 0.7 are mapped to prototype vector class C4. Feature vector signals from disjoint sub-subset 30 which have a Feature C value greater than or equal to 0.7 are mapped to prototype vector class C5.

In one embodiment of the invention, the classification rules comprise at least one scalar function mapping the feature values of a feature vector signal to a scalar value. At least one rule maps feature vector signals whose scalar function is less than a threshold to the first subset of feature vector signals. Feature vector signals whose scalar function is greater than the threshold are mapped to a second subset of feature vector signals different from the first subset. The scalar function of a feature vector signal may comprise the value of only a single feature of the feature vector signal, as shown in the example of FIG. 4.

The speech coding apparatus and method according to the present invention use classification rules to identify a subset of prototype vector signals that will be compared to a feature vector signal to find the prototype vector signal that is best-matched to the feature vector signal. The classification rules may be constructed, for example, using training data as follows. (Any other method of constructing classification rules, with or without training data, may alternatively be used.)

A large amount of training data (many utterances) may be coded (labeled) using the full labeling algorithm in which each feature vector signal is compared to all prototype vector signals in prototype vector signals store 12 in order to find the prototype vector signal having the best prototype match score.

Preferably, however, the training data is coded (labeled) by first provisionally coding the training data using the full labeling algorithm above, and then aligning (for example by Viterbi alignment) the training feature vector signals with elementary acoustic models in an acoustic model of the training script. Each elementary acoustic model is assigned a prototype identification value. (See, for example, U.S. patent application Ser. No. 730,714, filed on Jul. 16, 1991 entitled "Fast Algorithm For Deriving Acoustic Prototypes For Automatic Speech Recognition" by L. R. Bahl et al.) Each feature vector signal is then compared only to the prototype vector signals having the same prototype identification as the elementary model to which the feature vector signal is aligned in order to find the prototype vector signal having the best prototype match score.

For example, each prototype vector may be represented by a set of k single-dimension Gaussian distributions (referred to as atoms) along each of d dimensions. (See, for example, Lalit Bahl et al, "Speech Coding Apparatus With Single-Dimension Acoustic Prototypes For A Speech Recognizer", U.S. patent application Ser. No. 770,495, filed Oct. 3, 1991.) Each atom has a mean value and a variance value. The atoms along each dimension i can be ordered according to their mean values and can be numbered as $1^i, 2^i, \ldots, k^i$.

Each prototype vector signal consists of a particular combination of d atoms. The likelihood of a feature vector signal given one prototype vector signal is obtained by combining the prior probability of the prototype with the likelihood values calculated using each of the atoms making up the prototype vector signal. The prototype vector signal yielding the maximum likelihood for the feature vector signal has the best prototype match score, and the feature vector signal is labeled with the identification value of the best-matched prototype vector signal.

Thus, corresponding to each training feature vector signal is the identification value and the index of the best-matched prototype vector signal. Moreover, for each training feature vector signal there is also obtained the identification of each atom along each of the d dimensions which is closest to the feature vector signal according to some distance measure m. One specific distance measure m may be a simple Euclidean distance from the feature vector signal to the mean value of the atom.

We now construct classification rules using this data. Starting with all of the training data, the set of training feature vector signals is split into two subsets using a question about the closest atom associated with each training feature vector signal. The question is of the form "Is the closest atom (according to distance measure m) along dimension i one of $\{1^i, 2^i, \ldots, n^i\}$?", where n has a value between 1 and k, and i has a value between 1 and d.

Of the total number (kd) of questions which are candidates for classifying the feature vector signals, the best question can be identified as follows.

Let the set N of training feature vector signals be split into subsets L and R. Let the number of training feature vector signals in set N be $C_N$. Similarly, let $C_L$ and $C_R$ be the number of training feature vector signals in the two subsets L and R, respectively, created by splitting the set N. Let $r_{pN}$ be the number of training feature vector signals in set N with p as the prototype vector signal which yields the best prototype match score for the feature vector signal. Similarly, let $r_{pL}$ be the number of training feature vector signals in subset L with p as the prototype vector signal which yields the best prototype match score for the feature vector signal, and let $r_{pR}$ be the number of training feature vector signals in subset R with p as the prototype vector signal which yields the best prototype match score for the feature vector signal. We then define probabilities $$\mu_{pL} = \frac{r_{pL}}{c_L} \quad [1]$$

$$\mu_{pR} = \frac{r_{pR}}{c_R} \quad [2]$$

and we also have $$C_N = C_L + C_R \quad [3]$$

For each of the total of (kd) questions of the type described above, we calculate the average entropy of the prototypes given the resulting subsets using Equation 4:

$$f(N,q) = -\frac{c_L}{c_N}\left[\sum_p \mu_{pL}\log\mu_{pL}\right] - \frac{c_R}{c_N}\left[\sum_p \mu_{pR}\log\mu_{pR}\right] \quad [4]$$

The classification rule (question) which minimizes the entropy according to Equation 4 is selected for storage in classification rules store 14 and for use by classifier 16.

The same classification rule is used to split the set of training feature vector signals N into two subsets $N_L$ and $N_R$. Each subset $N_L$ and $N_R$ is split into two further sub-subsets using the same method described above until one of the following stopping criteria is met. If a subset contains less than a certain number of training feature vector signals, that subset is not further split. Also, if the maximum gain (the maximum difference between the entropy of the prototype vector signals at the the average entropy of the prototype vector signals at the sub-subsets) obtained for any split is less than a selected threshold, the subset is not split. Moreover, if the number of subsets reaches a selected limit, classification is stopped. To ensure that the maximum benefit is obtained with a fixed number of subsets, the subset with the highest entropy is split in each iteration.

In the method described thus far, the candidate questions were limited to those of the form "Is the closest atom along dimension i one of $\{1^i, 2^i, \ldots, n^i\}$?" Alternatively, additional candidate questions can be considered in an efficient manner using the method described in the article entitled "An Iterative "Flip-Flop" Approximation of the Most Informative Split in the Construction of Decision Trees," by A. Nadas, et al (1991 *International Conference on Acoustics, Speech and Signal Processing*, pages 565–568).

Each classification rule obtained thus far maps a feature vector signal from a set (or subset) of feature vector signals to exactly one of at least two disjoint subsets (or sub-subsets) of feature vector signals. According to the classification rules, there are obtained a number of terminal subsets of feature vector signals which are not mapped by classification rules into further disjoint sub-subsets.

To each terminal subset, exactly one class of prototype vector signals is assigned as follows. At each terminal subset of training feature vector signals, we accumulate a count for each prototype vector signal of the number of training feature vector signals to which the prototype vector signal is best matched. The prototype vector signals are then ordered according to these counts. The T prototype vector signals having the highest counts at a terminal subset of training feature vector signals form a class of prototype vector signals for that terminal subset. By varying the number T of prototype vector signals, labeling accuracy can be traded off against the computation time required for coding. Experimental results have indicated that acceptable speech coding is obtained for values of T greater than or equal to 10.

The classification rules may be either speaker-dependent if based on training data obtained from only one speaker, or may be speaker-independent if based on training data obtained from multiple speakers. The classification rules may alternatively be partially speaker-independent and partially speaker-dependent.

Figure 6:
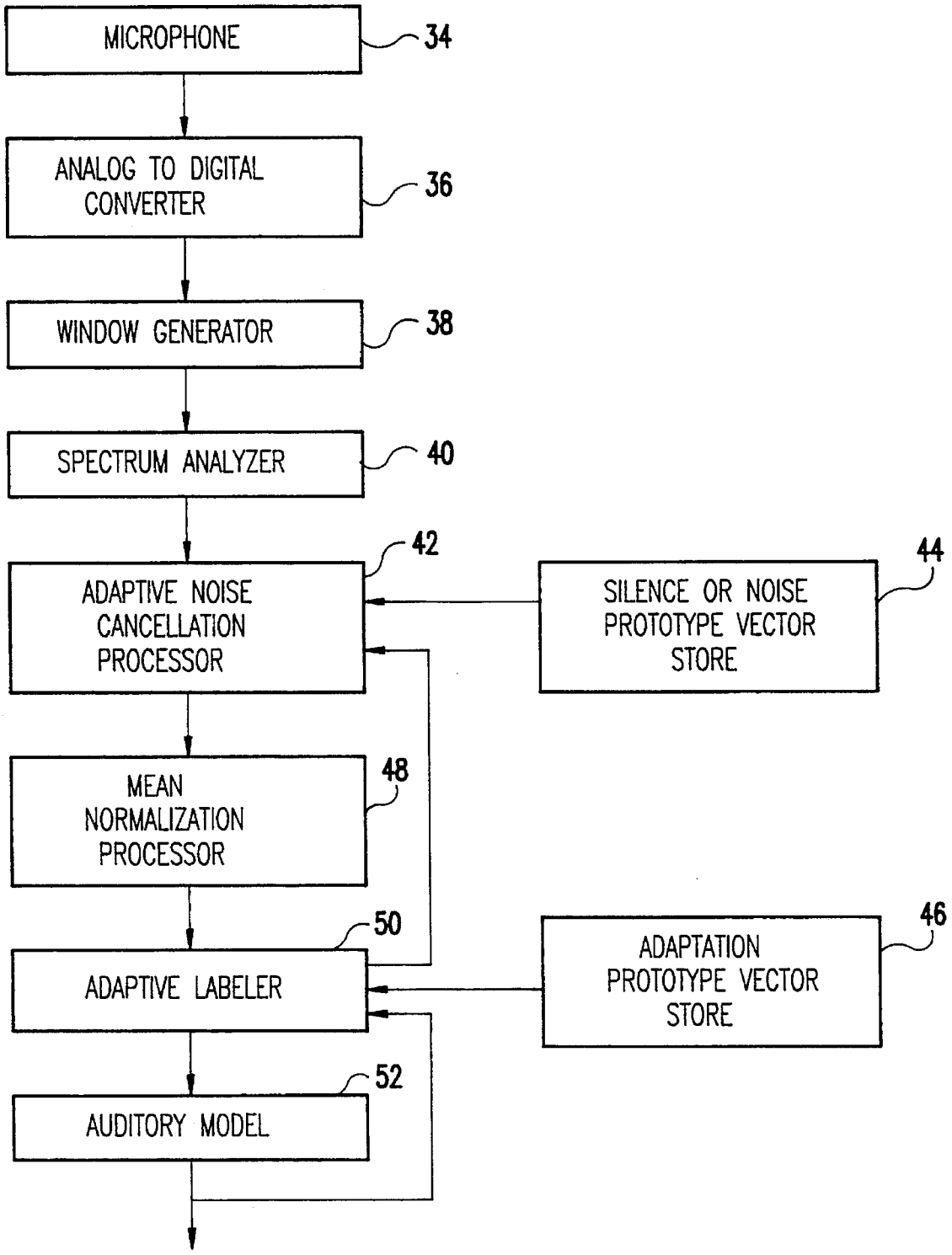
FIG. 6 is a block diagram of an example of the acoustic features value measure of FIG. 1.

One example of the acoustic features values measure 10 of FIG. 1 is shown in FIG. 6. The acoustic features values measure 10 comprises a microphone 34 for generating an analog electrical signal corresponding to the utterance. The analog electrical signal from microphone 34 is converted to a digital electrical signal by analog to digital converter 36. For this purpose, the analog signal may be sampled, for example, at a rate of twenty kilohertz by the analog to digital converter 36.

A window generator 38 obtains, for example, a twenty millisecond duration sample of the digital signal from analog to digital converter 36 every ten milliseconds (one centisecond). Each twenty millisecond sample of the digital signal is analyzed by spectrum analyzer 40 in order to obtain the amplitude of the digital signal sample in each of, for example, twenty frequency bands. Preferably, spectrum analyzer 40 also generates a signal representing the total amplitude or total energy of the twenty millisecond digital signal sample. For reasons further described below, if the total energy is below a threshold, the twenty millisecond digital signal sample is considered to represent silence. The spectrum analyzer 40 may be, for example, a fast Fourier transform processor. Alternatively, it may be a bank of twenty band pass filters. The twenty dimension acoustic vector signals produced by spectrum analyzer 40 may be adapted to remove background noise by an adaptive noise cancellation processor 42. Noise cancellation processor 42 subtracts a noise vector N(t) from the acoustic vector F(t) input into the noise cancellation processor to produce an output acoustic information vector F'(t). The noise cancellation processor 42 adapts to changing noise levels by periodically updating the noise vector N(t) whenever the prior acoustic vector F(t–1) is identified as noise or silence. The noise vector N(t) is updated according to the formula $$N(t) = \frac{N(t-1) + k[F(t-1) - Fp(t-1)]}{(1+k)}, \quad [5]$$

where N(t) is the noise vector at time t, N(t–1) is the noise vector at time (t–1), k is a fixed parameter of the adaptive noise cancellation model, F(t–1) is the acoustic vector input into the noise cancellation processor 42 at time (t–1) and which represents noise or silence, and Fp(t–1) is one silence or noise prototype vector, from store 44, closest to acoustic vector F(t–1).

The prior acoustic vector F(t–1) is recognized as noise or silence if either (a) the total energy of the vector is below a threshold, or (b) the closest prototype vector in adaptation prototype vector store 46 to the acoustic vector is a prototype representing noise or silence. For the purpose of the analysis of the total energy of the acoustic vector, the threshold may be, for example, the fifth percentile of all acoustic vectors (corresponding to both speech and silence) produced in the two seconds prior to the acoustic vector being evaluated.

After noise cancellation, the acoustic information vector F'(t) is normalized to adjust for variations in the loudness of the input speech by short term mean normalization processor 48. Normalization processor 48 normalizes the twenty dimension acoustic information vector F'(t) to produce a twenty dimension normalized vector X(t). Each component i of the normalized vector X(t) at time t may, for example, be given by the equation $$X_i(t) = F'_i(t) - Z(t) \quad [6]$$

in the logarithmic domain, where $F'_i(t)$ is the i-th component of the unnormalized vector at time t, and where Z(t) is a weighted mean of the components of F'(t) and Z(t−1) according to Equations 7 and 8:

$$Z(t)=0.9Z(t-1)+0.1M(t) \quad [7]$$

and where $$M(t)=\frac{1}{20}\sum_i F'_i(t) \quad [8]$$

The normalized twenty dimension vector X(t) may be further processed by an adaptive labeler 50 to adapt to variations in pronunciation of speech sounds. A twenty-dimension adapted acoustic vector X'(t) is generated by subtracting a twenty dimension adaptation vector A(t) from the twenty dimension normalized vector X(t) provided to the input of the adaptive labeler 50. The adaptation vector A(t) at time t may, for example, be given by the formula $$A(t)=\frac{A(t-1)+k[X(t-1)-Xp(t-1)]}{(1+k)}, \quad [9]$$

where k is a fixed parameter of the adaptive labeling model, X(t−1) is the normalized twenty dimension vector input to the adaptive labeler 50 at time (t−1), Xp(t−1) is the adaptation prototype vector (from adaptation prototype store 46) closest to the twenty dimension normalized vector X(t−1) at time (t−1), and A(t−1) is the adaptation vector at time (t−1).

The twenty-dimension adapted acoustic vector signal X'(t) from the adaptive labeler 50 is preferably provided to an auditory model 52. Auditory model 52 may, for example, provide a model of how the human auditory system perceives sound signals. An example of an auditory model is described in U.S. Pat. No. 4,980,918 to Bahl et al entitled "Speech Recognition System with Efficient Storage and Rapid Assembly of Phonological Graphs".

Preferably, according to the present invention, for each frequency band i of the adapted acoustic vector signal X'(t) at time t, the auditory model 52 calculates a new parameter $E_i(t)$ according to Equations 10 and 11:

$$E_i(t)=(K_1+K_2X'_i(t))(N_i(t-1))+K_4X'_i(t) \quad [10]$$

where $$N_i(t)=K_3\times N_i(t-1)-E_i(t) \quad [11]$$

and where $K_1$, $K_2$, $K_3$, and $K_4$ are fixed parameters of the auditory model.

For each centisecond time interval, the output of the auditory model 52 is a modified twenty-dimension amplitude vector signal. This amplitude vector is augmented by a twenty-first dimension having a value equal to the square root of the sum of the squares of the values of the other twenty dimensions. Preferably, each measured feature of the utterance according to the present invention is equal to a weighted combination of the values of a weighted mixture signal for at least two different time intervals. The weighted mixture signal has a value equal to a weighted mixture of the components of the 21-dimension amplitude vector produced by the auditory model 52. (See, "Speech Coding Apparatus And Method For Generating Acoustic Feature Vector Component Values By Combining Values Of The Same Features For Multiple Time Intervals" by Raimo Bakis et al. U.S. patent application Ser. No. 098,682, filed on Jul. 28, 1993.)

Alternatively, the measured features may comprise the components of the output vector X'(t) from the adaptive labeller 50, the components of the output vector X(t) from the mean normalization processor 48, the components of the 21-dimension amplitude vector produced by the auditory model 52, or the components of any other vector related to or derived from the amplitudes of the utterance in two or more frequency bands during a single time interval.

When each feature is a weighted combination of the values of a weighted mixture of the components of a 21-dimension amplitude vector, the weighted mixtures parameters may be obtained, for example, by classifying into M classes a set of 21-dimension amplitude vectors obtained during a training session of utterances of known words by one speaker (in the case of speaker-dependent speech coding) or many speakers (in the case of speaker-independent speech coding). The covariance matrix for all of the 21-dimension amplitude vectors in the training set is multiplied by the inverse of the within-class covariance matrix for all of the amplitude vectors in all M classes. The first 21 eigenvectors of the resulting matrix form the weighted mixtures parameters. (See, for example, "Vector Quantization Procedure for Speech Recognition Systems Using Discrete Parameter Phoneme-Based Markov Word Models" by L. R. Bahl, et al. *IBM Technical Disclosure Bulletin*, Vol. 32, No. 7, December 1989, pages 320 and 321). Each weighted mixture is obtained by multiplying a 21-dimension amplitude vector by an eigenvector.

In order to discriminate between phonetic units, the 21-dimension amplitude vectors from auditory model 52 may be classified into M classes by tagging each amplitude vector with the identification of its corresponding phonetic unit obtained by Viterbi aligning the series of amplitude vector signals corresponding to the known training utterance with phonetic unit models in a model (such as a Markov model) of the known training utterance. (See, for example, F. Jelinek. "Continuous Speech Recognition By Statistical Methods." *Proceedings of the IEEE*, Vol. 64, No. 4, April 1976, pages 532–556.)

The weighted combinations parameters may be obtained, for example, as follows. Let $G_j(t)$ represent the component j of the 21-dimension vector obtained from the twenty-one weighted mixtures of the components of the amplitude vector from auditory model 52 at time t from the training utterance of known words. For each j in the range from 1 to 21, and for each time interval t, a new vector $Y_j(t)$ is formed whose components are $G_j(t-4)$, $G_j(t-3)$, $G_j(t-2)$, $G_j(t-1)$, $G_j(t)$, $G_j(t+1)$, $G_j(t+2)$, $G_j(t+3)$, and $G_j(t+4)$. For each value of j from 1 to 21, the vectors $Y_j(t)$ are classified into N classes (such as by Viterbi aligning each vector to a phonetic model in the manner described above). For each of the twenty-one collections of 9-dimension vectors (that is, for each value of j from 1 to 21) the covariance matrix for all of the vectors $Y_j(t)$ in the training set is multiplied by the inverse of the within-class covariance matrix for all of the vectors $Y_j(t)$ in all classes. (See, for example, "Vector Quantization Procedure for Speech Recognition Systems Using Discrete Parameter Phoneme-Based Markov Word Models" by L. R. Bahl, et al. *IBM Technical Disclosure Bulletin*, Vol. 32, No. 7, December 1989, pages 320 and 321).

For each value of j (that is, for each feature produced by the weighted mixtures), the nine eigenvectors of the resulting matrix, and the corresponding eigenvalues are identified. For all twenty-one features, a total of 189 eigenvectors are identified. The fifty eigenvectors from this set of 189 eigenvectors having the highest eigenvalues, along with an index identifying each eigenvector with the feature j from which it was obtained, form the weighted combinations parameters. A weighted combination of the values of a feature of the utterance is then obtained by multiplying a selected eigenvector having an index j by a vector $Y_j(t)$.

In another alternative, each measured feature of the utterance according to the present invention is equal one component of a fifty-dimension vector obtained as follows. For each time interval, a 189-dimension spliced vector is formed by concatenating nine 21-dimension amplitude vectors produced by the auditory model 52 representing the one current centisecond time interval, the four preceding centisecond time intervals, and the four following centisecond time intervals. Each 189-dimension spliced vector is multiplied by a rotation matrix to rotate the spliced vector to produce a fifty-dimension vector.

The rotation matrix may be obtained, for example, by classifying into M classes a set of 189 dimension spliced vectors obtained during a training session. The covariance matrix for all of the spliced vectors in the training set is multiplied by the inverse of the within-class covariance matrix for all of the spliced vectors in all M classes. The first fifty eigenvectors of the resulting matrix form the rotation matrix. (See, for example, "Vector Quantization Procedure For Speech Recognition Systems Using Discrete Parameter Phoneme-Based Markov Word Models" by L. R. Bahl, et al, *IBM Technical Disclosure Bulletin*, Volume 32, No. 7, December 1989, pages 320 and 321.)

In the speech coding apparatus according to the present invention, the classifier 16 and the comparator 18 may be suitably programmed special purpose or general purpose digital signal processors. Prototype vector signals store 12 and classification rules store 14 may be electronic read only or read/write computer memory.

In the acoustic features values measure 10, window generator 38, spectrum analyzer 40, adaptive noise cancellation processor 42, short term mean normalization processor 48, adaptive labeller 50, and auditory mode 52 may be suitably programmed special purpose or general purpose digital signal processors. Prototype vector stores 44 and 46 may be electronic computer memory of the types discussed above.

The prototype vector signals in prototype vector signals store 12 may be obtained, for example, by clustering feature vector signals from a training set into a plurality of clusters, and then calculating the mean and standard deviation for each cluster to form the parameter values of the prototype vector. When the training script comprises a series of word-segment models (forming a model of a series of words), and each word-segment model comprises a series of elementary models having specified locations in the word-segment models, the feature vector signals may be clustered by specifying that each cluster corresponds to a single elementary model in a single location in a single word-segment model. Such a method is described in more detail in U.S. patent application Ser. No. 730,714, filed on Jul. 16, 1991, entitled "Fast Algorithm For Deriving Acoustic Prototypes For Automatic Speech Recognition" by L. R. Bahl et al.

Alternatively, all acoustic feature vectors generated by the utterance of a training text and which correspond to a given elementary model may be clustered by K-means Euclidean clustering or K-means Gaussian clustering, or both. Such a method is described, for example, by Bahl et al in U.S. Pat. No. 5,182,773 entitled "Speaker Independent Label Coding Apparatus".

We claim:

1. A speech coding apparatus comprising:

means for measuring the value of at least one feature of an utterance during each of a series of successive time intervals to produce a series of feature vector signals representing the feature values;

means for storing a plurality of prototype vector signals, each prototype vector signal having at least one parameter value and having an identification value, at least two prototype vector signals having different identification values;

classification rules means for storing classification rules mapping each feature vector signal from a set of all possible feature vector signals to exactly one of at least two different classes of prototype vector signals, each class containing a plurality of prototype vector signals and each class of prototype vector signals is at least partially different from other classes of prototype vector signals, wherein each class of prototype vector signals contains less than 1/N times the total number of prototype vector signals in all classes, where $5 \leqq N \leqq 150$;

classifier means for mapping, by the classification rules, a first feature vector signal to a first class of prototype vector signals;

means for comparing the closeness of the feature value of the first feature vector signal to the parameter values of only the prototype vector signals in the first class of prototype vector signals to obtain prototype match scores for the first feature vector signal and each prototype vector signal in the first class; and means for outputting at least the identification value of at least the prototype vector signal having the best prototype match score as a coded utterance representation signal of the first feature vector signal.

2. A speech coding apparatus as claimed in claim 1, characterized in that the average number of prototype vector signals in a class of prototype vector signals is approximately equal to 1/10 times the total number of prototype vector signals in all classes.

3. A speech coding apparatus as claimed in claim 1, characterized in that:

the classification rules comprise at least first and second sets of classification rules;

the first set of classification rules map each feature vector signal from a set of all possible feature vector signals to exactly one of at least two disjoint subsets of feature vector signals; and the second set of classification rules map each feature vector signal in a subset of feature vector signals to exactly one of at least two different classes of prototype vector signals, wherein the classification rules are determined by an entropy of the prototype vector signals.

4. A speech coding apparatus as claimed in claim 3, characterized in that the classifier means maps, by the first set of classification rules, the first feature vector signal to a first subset of feature vector signals.

5. A speech coding apparatus as claimed in claim 4, characterized in that the classifier means maps, by the second set of classification rules, the first feature vector signal from the first subset of feature vector signals to the first class of prototype vector signals.

6. A speech coding apparatus as claimed in claim 4, characterized in that:

the second set of classification rules comprises at least third and fourth sets of classification rules;

the third set of classification rules map each feature vector signal from a subset of feature vector signals to exactly one of at least two disjoint sub-subsets of feature vector signals; and the fourth set of classification rules map each feature vector signal in a sub-subset of feature vector signals to exactly one of at least two different classes of prototype vector signals.

7. A speech coding apparatus as claimed in claim 6, characterized in that the classifier means maps, by the third set of classification rules, the first feature vector signal from the first subset of feature vector signals to a first sub-subset of feature vector signals.

8. A speech coding apparatus as claimed in claim 7, characterized in that the classifier means maps, by the fourth set of classification rules, the first feature vector signal from the first sub-subset of feature vector signals to the first class of prototype vector signals.

9. A speech coding apparatus as claimed in claim 8, characterized in that the classification rules comprise:

at least one scalar function mapping the feature values of a feature vector signal to a scalar value; and at least one rule mapping feature vector signals whose scalar function is less than a threshold to the first subset of feature vector signals, and mapping feature vector signals whose scalar function is greater than the threshold to a second subset of feature vector signals different from the first subset.

10. A speech coding apparatus as claimed in claim 9, characterized in that:

the measuring means measures the values of at least two features of an utterance during each of a series of successive time intervals to produce a series of feature vector signals representing the feature values; and the scalar function of a feature vector signal comprises the value of only a single feature of the feature vector signal.

11. A speech coding apparatus as claimed in claim 10, characterized in that the measuring means comprises a microphone.

12. A speech coding apparatus as claimed in claim 11, characterized in that the measuring means comprises a spectrum analyzer for measuring the amplitudes of the utterance in two or more frequency bands during each of a series of successive time intervals.

13. A speech coding apparatus comprising:

means for measuring the value of at least one feature of an utterance during each of a series of successive time intervals to produce a series of feature vector signals representing feature values;

means for storing a plurality of prototype vector signals, each prototype vector signal having at least one parameter value and having an identification value, at least two prototype vector signals having different identification values;

classification rules means for storing classification rules mapping each feature vector signal from a set of all possible feature vector signals to exactly one of at least two different classes of prototype vector signals, each class containing a plurality of prototype vector signals;

classifier means for mapping, by the classification rules, a first feature vector signal to a first class of prototype vector signals;

means for comparing the closeness of the feature value of the first feature vector signal to the parameter values of only the prototype vector signals in the first class prototype vector signals to obtain prototype match scores for the first feature vector signal and each prototype vector signal in the first class, wherein the closeness of the feature vector signal to the prototype vector signal is one of a Euclidian distance and a Gaussian distance; and means for outputting at least the identification value of at least the prototype vector signal having the best prototype match score as a coded utterance representation signal of the first feature vector signal.

14. A speech coding method comprising the steps of:

measuring the value of at least one feature of an utterance during each of a series of successive time intervals to produce a series of feature vector signals representing the feature values;

storing a plurality of prototype vector signals, each prototype vector signal having at least one parameter value and having an identification value, at least two prototype vector signals having different identification values;

storing classification rules mapping each feature vector signal from a set of all possible feature vector signals to exactly one of at least two different classes of prototype vector signals, each class containing a plurality of prototype vector signals and each class of prototype vector signals is at least partially different from other classes of prototype vector signals, wherein each class of prototype vector signals contains less than 1/N times the total number of prototype vector signals in all classes, where $5 \leqq N \leqq 150$;

mapping, by the classification rules, a first feature vector signal to a first class of prototype vector signals;

comparing the closeness of the feature value of the first feature vector signal to the parameter values of only the prototype vector signals in the first class of prototype vector signals to obtain prototype match scores for the first feature vector signal and each prototype vector signal in the first class; and outputting at least the identification value of at least the prototype vector signal having the best prototype match score as a coded utterance representation signal of the first feature vector signal.

15. A speech coding method as claimed in claim 14, characterized in that the average number of prototype vector signals in a class of prototype vector signals is approximately equal to 1/10 times the total number of prototype vector signals in all classes.

16. A speech coding method as claimed in claim 14, characterized in that:

the classification rules comprise at least first and second sets of classification rules;

the first set of classification rules map each feature vector signal from a set of all possible feature vector signals to exactly one of at least two disjoint subsets of feature vector signals; and the second set of classification rules map each feature vector signal in a subset of feature vector signals to exactly one of at least two different classes of prototype vector signals, wherein the classification rules are determined by an entropy of the prototype vector signals.

17. A speech coding method as claimed in claim 16, characterized in that the step of mapping comprises mapping, by the first set of classification rules, the first feature vector signal to a first subset of feature vector signals.

18. A speech coding method as claimed in claim 17, characterized in that the step of mapping comprises mapping, by the second set of classification rules, the first feature vector signal from the first subset of feature vector signals to the first class of prototype vector signals.

19. A speech coding method as claimed in claim 17, characterized in that:

the second set of classification rules comprises at least third and fourth sets of classification rules;

the third set of classification rules map each feature vector signal from a subset of feature vector signals to exactly one of at least two disjoint sub-subsets of feature vector signals; and the fourth set of classification rules map each feature vector signal in a sub-subset of feature vector signals to exactly one of at least two different classes of prototype vector signals.

20. A speech coding method as claimed in claim 19, characterized in that the step of mapping comprises mapping by the third set of classification rules, the first feature vector signal from the first subset of feature vector signals to a first sub-subset of feature vectors signals.

21. A speech coding method as claimed in claim 20, characterized in that the classifier means maps, by the fourth set of classification rules, the first feature vector signal from the first sub-subset of feature vector signals to the first class of prototype vector signals.

22. A speech coding method as claimed in claim 21, characterized in that the classification rules comprise:

at least one scalar function mapping the feature values of a feature vector signal to a scalar value; and at least one rule mapping feature vector signals whose scalar function is less than a threshold to the first subset of feature vector signals, and mapping feature vector signals whose scalar function is greater than the threshold to a second subset of feature vector signals different from the first subset.

23. A speech coding method as claimed in claim 22, characterized in that:

the step of measuring comprising measuring the values of at least two features of an utterance during each of a series of successive time intervals to produce a series of feature vector signals representing the feature values; and the scalar function of a feature vector signal comprises the value of only a single feature of the feature vector signal.

24. A speech coding method as claimed in claim 23, characterized in that the step of measuring comprises measuring the amplitudes of the utterance in two or more frequency bands during each of a series of successive time intervals.

25. A speech coding method comprising the steps of:

measuring the value of at least one feature of an utterance during each of a series of successive time intervals to produce a series of feature vector signals representing the feature values;

storing a plurality of prototype vector signals, each prototype vector signal having at least one parameter vector and having an identification value, at least two prototype vector signals having different identification values;

storing classification rules mapping each feature vector from a set of all possible feature vectors to exactly one of at least two different classes of prototype vector signals, each class containing a plurality of prototype vector signals;

mapping, by the classification rules, a first feature vector signal to a first class of prototype vector signals;

comparing the closeness of the feature vector to the first feature vector signal to the parameter vectors of only the prototype vector signals in the first class of prototype vector signals to obtain prototype match scores for the first feature vector signal and each prototype vector signal in the first class, wherein the comparing step includes comparing the closeness of the feature vector signal to the prototype vector signal using is one of a Euclidian distance and a Gaussian distance; and outputting at least the identification value of at least the prototype vector signal having the best prototype match score as a coded utterance representation signal of the first feature vector signal.

* * * * *